United States Patent [19]

Miura

[11] Patent Number: 4,993,396

[45] Date of Patent: Feb. 19, 1991

[54] METHOD FOR DRIVING AN INSULATED GATE SEMICONDUCTOR DEVICE

[75] Inventor: Shunji Miura, Matumoto, Japan

[73] Assignee: Fuji Electric Co., Ltd., Kawasaki, Japan

[21] Appl. No.: 405,741

[22] Filed: Sep. 11, 1989

[30] Foreign Application Priority Data

Sep. 16, 1988 [JP] Japan ..... 63-232003

[51] Int. Cl.[5] ..... F02P 1/08

[52] U.S. Cl. ..... 123/651; 123/149 R; 307/570; 307/584

[58] Field of Search ..... 123/149 R, 149 A, 149 C, 123/651, 652; 307/296.6, 296.7, 296.8, 570, 581, 584

[56] References Cited

U.S. PATENT DOCUMENTS 4,342,304 8/1982 Watanabe ..... 123/651 X 4,501,256 2/1985 Dykstra ..... 123/651

FOREIGN PATENT DOCUMENTS 63-27546 6/1988 Japan .

*Primary Examiner*—Tony M. Argenbright

*Attorney, Agent, or Firm*—Brumbaugh, Graves, Donohue & Raymond

[57] ABSTRACT

The present invention relates to a method for biasing and making conductive an insulated gate semiconductor device having main electrodes at both surfaces of a semiconductor substrate and a gate electrode at one surface. Charges are accumulated between the gate electrode and the main electrode at the opposite surface while a voltage is applied across the electrodes storing a charge. The element is made conductive by discharging the accumulated charges when a voltage is applied in the conductive direction to such semiconductor element. The device can be used to drive the primary side of an ignition system in an internal combustion engine.

16 Claims, 2 Drawing Sheets

METHOD FOR DRIVING AN INSULATED GATE SEMICONDUCTOR DEVICE

FIELD OF THE INVENTION

The present invention relates to a method for driving or biasing, and making conductive an insulated gate semiconductor device, which can be used in activating the ignition system of an internal combustion engine.

BACKGROUND OF THE INVENTION

An ignition system of an internal combustion engine found in the prior art is shown in FIG. 2. The circuit comprises a Darlington transistor 23, a thyristor 24, resistors R1 through R6, a protection diode 27, an ignition plug 25, a zener diode 26, and an ignition coil 2. The ignition coil 2 comprises a primary coil 21, a secondary coil 22, and terminals A and B. As depicted therein, the Darlington transistor 23 and the thyristor 24 are connected in series to the resistor R1 across the primary coil 21 of the ignition coil 2. When a voltage is generated in accordance with the rotation of a flywheel magnet at terminals A and B of the primary side of the ignition coil 2, terminal A is rendered positive with respect to terminal B. A base current of the Darlington transistor 23 thereby flows through the resistor R1 and a collector current also flows in accordance with the amplification factor of the Darlington transistor 23. When the voltage at terminal A increases further, the thyristor 24 turns ON with a voltage determined by the voltage divider formed by resistors R2 and R3. Resistors R2 and R3 can be adjusted so that the voltage at terminal A is at a certain desired value when this occurs. When the thyristor 24 turns ON, current ceases flowing into the base of the Darlington transistor 23, switching the Darlington transistor 23 OFF. Thereby, a voltage as high as several hundred volts is generated at the primary side of the ignition coil 2, enabling the ignition plug 25, provided at the end part of the secondary coil 22, to fire.

The zener diode 26 is provided to protect the Darlington transistor 23 from damage resulting from high voltages. In addition, when terminal B of the ignition coil 2 becomes positive with respect to terminal A, the protection diode 27 and the resistor R4 suppress the voltage to be applied to the Darlington transistor 23 from the terminal B so as to prevent misfiring of the ignition plug 25.

In the prior art circuit of FIG. 2, a small voltage is generated in the primary side of the ignition coil 2 as the internal combustion engine revolves at a low speed, and voltages on the order of two volts are generated during operation at 400 to 500 revolutions per minute (RPM). It has therefore been difficult to obtain the energy necessary for ignition at low speed if the amplification factor of the Darlington transistor 23 is not large enough. However, if the amplification factor of the Darlington transistor 23 is too large, the collector-emitter voltage is lowered, and secondary breakdown is generated, resulting in serious adverse effects on the circuit at higher speeds.

As a means for solving the problems described above to economically obtain the energy required for ignition, even during low speed revolution of an internal combustion engine, an insulated gate semiconductor device, such as an insulated gate bipolar transistor (IGBT) could be considered in place of the Darlington transistor. Consideration could also be given to use of a power metal-oxide semiconductor field effect transistor (MOSFET) having main electrodes on both side surfaces and having the insulated gate structure on one surface. However, in order to drive the IGBT or MOSFET, it would be necessary to bias the device with a voltage that is higher than the gate threshold voltage. This voltage is a function of the transmission characteristic across the gate and emitter (for the IGBT) or across the gate and source (for the MOSFET). In general, a voltage of 5 volts or higher would be required for such biasing.

In such a general biasing method, the biasing voltage generated at low revolution speeds in the prior art circuit is too low to drive the IGBT or MOSFET. Although additional driving circuits can be provided, such additional circuits are uneconomical because of additional circuit components and complexity required.

Accordingly, it is an object of the present invention to provide a method for driving or biasing an insulated gate semiconductor device such as an IGBT or MOSFET without additionally providing a driving circuit, even when only a low voltage is available across the gate and emitter of the IGBT or across the gate and source of the MOSFET.

SUMMARY OF THE INVENTION

To overcome the problems mentioned above, the present invention proposes a method for driving an insulated gate semiconductor device characterized in having main electrodes at both surfaces of a semiconductor substrate, by first accumulating charges (to be used to drive a semiconductor element having a gate electrode through an insulated film on a channel layer provided only at the first surface) between the gate electrode and the main electrode at the other surface while a voltage is applied across both main electrodes in the non-conductive direction of the semiconductor element in a manner not permitting the charges to be leaked, and then making the element conductive by discharging the accumulated charges between the gate electrode and the main electrode at the first surface, in response to a voltage applied to such semiconductor element in a conductive direction. This method in accordance with the invention is effective for controlling the semiconductor device without additional means for providing an electrical bias as required in the prior art.

Moreover, the present invention proposes a method for providing electrical energy to the ignition plug of an internal combustion engine, utilizing an insulated gate semiconductor device of the type having gate and first main electrodes at one surface of a semiconductor substrate, a second main electrode at a second substrate surface, and a gate to second main electrode capacitance which is a multiple of the gate to first main electrode capacitance under low voltage conditions, comprising the following steps. A flywheel magnet is rotated through the field of an ignition coil alternately to generate voltages of a first and reverse polarity in the primary winding of said coil and a charge is accumulated between said gate and second main electrodes in response to the first voltage coupled across said main electrodes in a non-conductive polarity. Leakage of said charge is prevented as it accumulates by providing electrical isolation for charges of the resulting polarity. The accumulated charge is caused to discharge between the gate and first main electrodes in response to the reverse voltage applied across said main electrodes, thereby temporarily driving said gate electrode to a potential adequate to cause the semiconductor device to enter a conductive state. The semiconductor device is then caused to rapidly change from a conductive to a non-conductive state. An increased voltage is thereby generated in the primary winding of said ignition coil and the resulting energy generated in the secondary winding of said coil is coupled to the ignition plug of the engine.

Further in accordance with the invention, an ignition circuit for an internal combustion engine includes inductive means for alternately coupling voltages of a first and a reverse polarity across first and second circuit points and an insulated gate semiconductor device having first and second main electrodes respectively coupled to the first and second points, and having a gate electrode. The circuit includes first means, coupling the gate electrode to the first point, for coupling voltages of said first polarity to the gate electrode and for preventing leakage of charge from the gate electrode, and second means, coupled between the first main electrode and the first circuit point and responsive to reverse polarity voltages, for permitting discharge of the gate electrode via the second main electrode, thereby rendering the semiconductor device conductive. Also included are third means, coupled between the gate electrode and second circuit point and responsive to reverse polarity voltages, for causing the semiconductor device to become non-conductive. The semiconductor device having been rendered conductive by discharge of the gate electrode, causes generation of ignition firing voltages in the inductive means upon being rendered non-conductive.

DESCRIPTION OF THE PREFERRED EMBODIMENT

Figure 1:
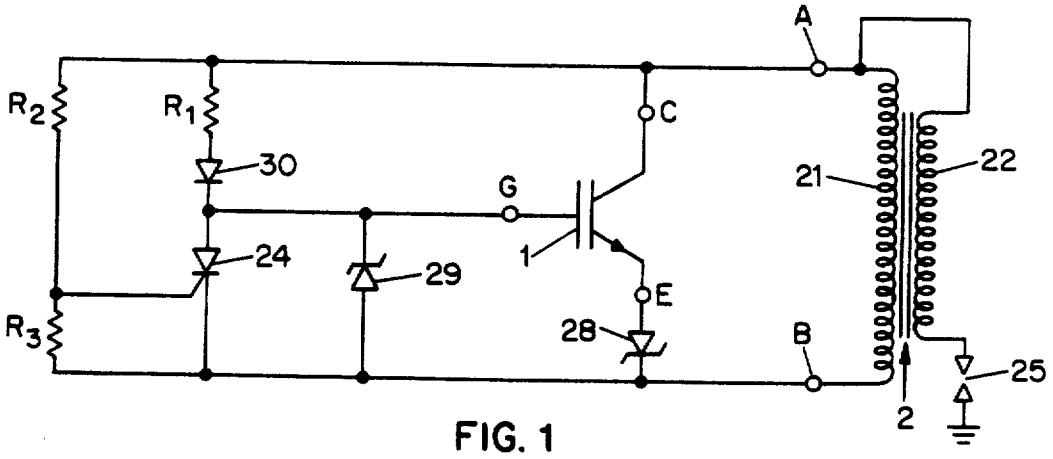
FIG. 1 is a circuit diagram of the ignition system utilizing an embodiment of the present invention.

According to the present invention, a forward bias condition which is sufficient for turning ON an insulated gate semiconductor element, such as an IGBT or a power MOSFET, is achieved by accumulating charges between the gate and main electrode on the opposite semiconductor substrate surface from this gate, while a backward voltage is applied across both main electrodes. Then, by discharging such accumulated charges while a forward voltage is applied, the insulated semiconductor element is turned ON by a bias of increased voltage resulting from the difference in interelectrode capacitances. Thereby, an internal combustion engine can be fired at a low number of revolutions by using an insulated gate semiconductor element without the necessity for an additional bias supply arrangement.

The principle of the present invention will be explained with reference to FIG. 3. Illustrated is an equivalent circuit of an IGBT showing a gate electrode G and first main electrode embodied by an emitter E located at one surface of a semiconductor substrate, a second main electrode embodied by a collector C located at a second substrate surface, a gate to first main electrode capacitance embodied by gate-emitter inter-electrode capacitance 32, a gate to second main electrode capacitance embodied by gate-collector inter-electrode capacitance 31, an emitter-collector interelectrode capacitance 33, and diodes 34 and 35. Under low voltage conditions, the gate-collector inter-electrode capacitance 31 is a multiple of the gate-emitter inter-electrode capacitance 32, for example, five times or more. This is shown graphically in FIG. 5. When the gate-collector inter-electrode capacitance 31 is charged while the emittercollector junction is reverse biased, the gate-emitter bias voltage automatically increases during discharge while the forward voltage is being applied and the resulting bias voltage applied between the emitter E and collector C is capable of driving the IGBT, even if the voltage initially applied to capacitance 31 is at a low level. In the case of a power MOSFET, the analysis is similar; however, the built-in diode 35 is not present.

Figure 2:
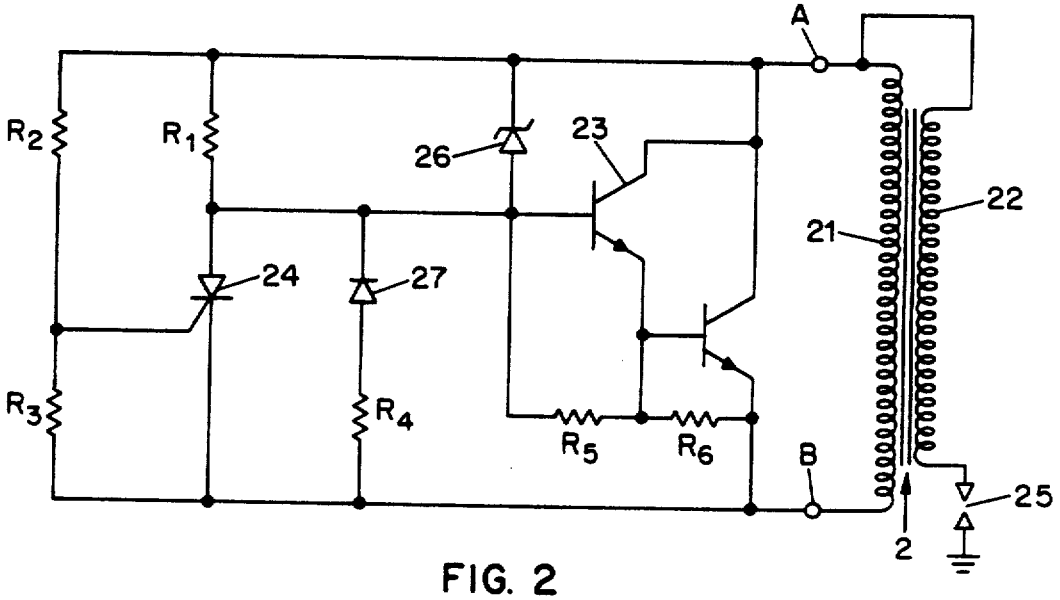
FIG. 2 (PRIOR ART)
FIG. 2 is a circuit diagram of the ignition system of the prior art.
Figure 3:
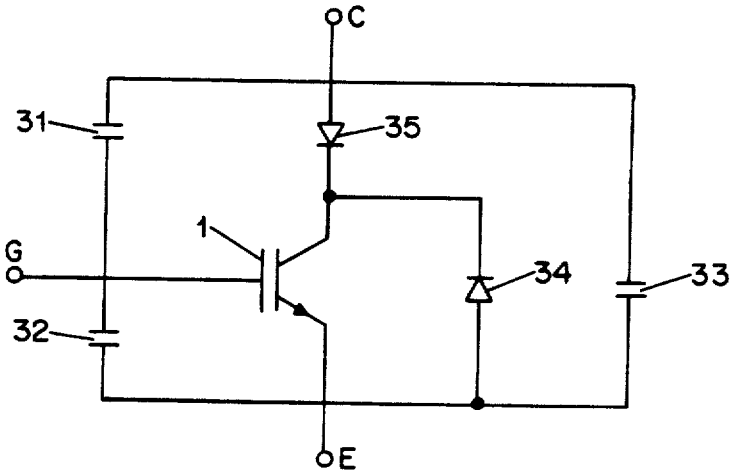
FIG. 3 is an equivalent circuit of an IGBT.

FIG. 1 illustrates an ignition system utilizing an embodiment of the present invention in which an insulated gate semiconductor device, shown as IGBT 1, is employed Elements corresponding to ones illustrated in FIGS. 2 and 3 are designated with the same reference numerals. A first main electrode shown as emitter terminal E of IGBT 1 is coupled to first circuit point B via zener diode 28, whose cathode is connected to terminal B of the inductive means shown as primary coil or winding 21 of the ignition coil 2. A second main electrode, collector terminal C of IGBT 1, is connected to a second circuit point shown as terminal A of primary coil 21. Terminal G at the gate electrode of IGBT 1 is coupled to the first circuit point B via first means shown as zener diode 29, whose anode is connected to the cathode of second means, shown as zener diode 28. Since zener diode 29 is used to protect the gate-emitter junction of IGBT 1 from excessive voltage, a reverse breakdown voltage is selected in accordance therewith, generally on the order of several tens of volts.

Third means, shown as resistors R2 and R3 and thyristor 24, couples the gate electrode to the first circuit point. Thyristor 24 is also coupled to the second circuit point A by the third diode 30 and resistor R1.

Resistor R1 is connected at one end to the anode of diode 30 and at its other end to the collector terminal C of IGBT 1. The cathode of diode 30 is connected to the gate terminal G of IGBT 1. Resistor R1 and diode 30 are provided for generating a bias voltage across the gate and emitter of IGBT 1 when terminal A of the ignition coil 2 is at a certain predetermined voltage. Diode 30 acts to electrically isolate the gate G, preventing leakage through resistor R1 of charges accumulated there.

The anode of thyristor 24 is connected to the gate terminal G of IGBT 1, while the cathode of thyristor 24 is connected to the cathode of zener diode 28. Resistors R2 and R3 are connected in series between terminals A and B of the ignition coil 2. The control electrode gate of thyristor 24 is connected to the junction therebetween, creating a resistive voltage divider in accordance with the values of resistors R2 and R3.

Figure 4A:
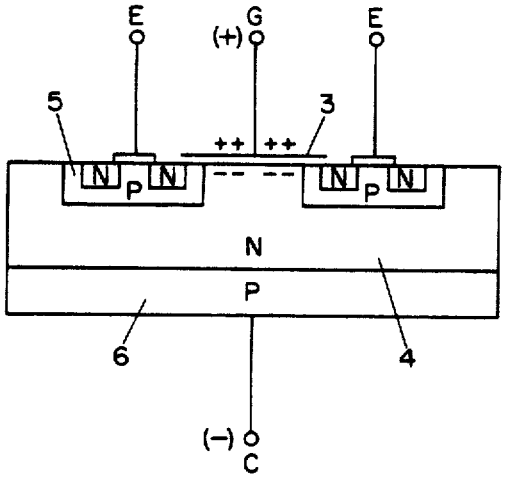
FIGS. 4(*a*) and (*b*) are cross-sectional views for explaining the principle of the present invention.
Figure 4B:
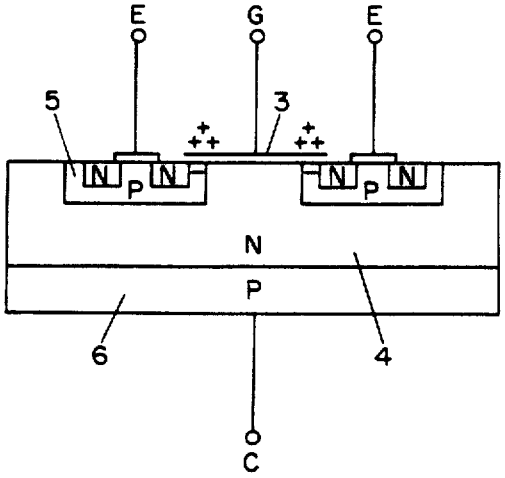

The operation of the system described above is explained as follows. A voltage of alternating polarity is generated across the primary coil 21 of the ignition coil 2 by the rotation of a conventional flywheel magnet through the field of the coil 2. When a first voltage is coupled across the main electrodes, a low level voltage is generated at first circuit point B which is positive with respect to second circuit point A and charges are accumulated in a non-conductive polarity across the gate electrode G and second main electrode collector C of IGBT 1 through the diode 29. This will happen, for example, when the number of rotations of the internal combustion engine is several hundred and the voltage generated is approximately 2 volts. Referring additionally to FIG. 4(*a*), it can be seen that the connection of zener diode 28 allows charge to first accumulate through the insulation layer across the gate 3 and base layer 4. If the zener diode 28 is not utilized in this fashion, since a voltage is applied to the N base layer 4 under the gate through the P channel layer 5 of the emitter E, charge would not be accumulated through the insulation layer between the gate and the base even if a voltage is applied across the gate and collector. Rather, charge would be accumulated in the N base layer 4 and P collector layer 6. With the connection of diode 28, charge can be accumulated first through the insulation layer across the gate 3 and base layer 4. When terminal A of the ignition coil 2 becomes positive with respect to terminal B and a voltage of approximately 2 volts is generated, charges accumulated through the insulation layer across the gate 3 and base layer 4 are also temporarily accumulated through the insulation layer across the gate 3 and channel layer 5, as shown in FIG. 4(*b*).

Figure 5:
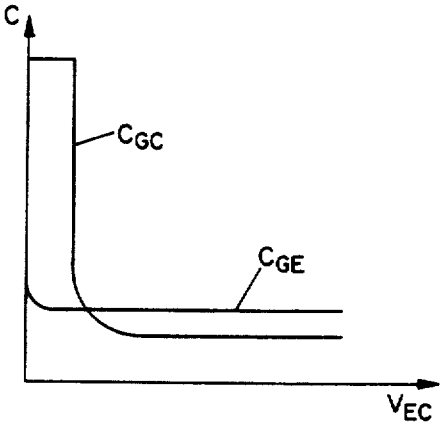
FIG. 5 is a diagram indicating the relationship between the emitter-collector voltage of an IGBT and the capacitance between the gate-collector and gate-emitter.

When the emitter-collector voltage $V_{EC}$ in an insulated gate semiconductor element is 10 volts or lower, the gate-collector capacitance $C_{GC}$ will be five times or more than the gate-emitter capacitance $C_{GE}$ as previously described in conjunction with FIGS. 3 and 5. With the accumulated charge designated as Q, capacitance as C, and voltage as V, the general relationship $Q=CV$ is used to determine the gate-emitter voltage $V_{GE}$. Since the accumulated charge Q located at the gate G doesn't appreciably leak out and therefore does not change, the product $C_{GC}V_{GC}$ is equal to the product $C_{GE}V_{GE}$. With $C_{GC}$ five times the value of $C_{GE}$, $V_{GE}$ will therefore be five times the value of $V_{GC}$. When a second voltage is applied across the main electrodes in the opposite polarity to the first voltage, the accumulated charge will discharge between the gate and first main electrode, temporarily biasing the gate electrode to a potential adequate to cause the semiconductor to enter a conductive state. This bias of increased voltage results from the difference in inter-electrode capacitance, effectively driving the semiconductor device. Namely, when the terminal B of the ignition coil 2 is 2 volts with respect to terminal A, the voltage difference across the gate and emitter becomes approximately 10 volts. Therefore, when the threshold voltage across the gate and emitter is around 3 to 8 volts, it provides the bias condition to make IGBT 1 conductive. With the voltage drop across IGBT 1 and diode 28 at 2 volts or less, and the collector-emitter voltage $V_{CE}$ at 2 volts, IGBT 1 will turn ON.

After IGBT 1 turns ON, the terminal A of the ignition coil 2 will reach a certain predetermined voltage in accordance with the desired ignition timing, and the thyristor 24 will turn ON with the voltage at the voltage divider comprised of R2 and R3. This will cause the semiconductor device to rapidly change from a conductive to a non-conductive state. Namely, this will turn IGBT 1 OFF, generating an increased voltage in the primary winding of the coil 2, at terminal A, and the energy required for firing is coupled in the secondary side 22 of the ignition coil 2, thereby firing the ignition plug 25. This process is repeated in the next cycle and the internal combustion engine is driven in the same way. When the number of revolutions of the internal combustion engine increases whereby the voltage generated increases and exceeds the threshold voltage across the gate and emitter of IGBT 1, the accumulation of charges across the gate and collector through the diode 29 during reverse bias is no longer necessary. However, accumulation of charges from terminal B under reverse bias condition turns IGBT 1 ON quickly and provides the effect of easily attaining the ignition timing.

The reverse breakdown voltage of diode 28 should be between 10 and 30 volts since it is necessary to keep terminal B of the ignition coil 2 under a predetermined voltage in order to prevent misfiring. In addition, diode 28 prevents voltage breakdown between the gate and collector of the IGBT 1.

The reverse breakdown voltage of diode 29 must be several tens of volts, which is higher than the voltage required for driving across the gate and emitter of IGBT 1, and is lower than the breakdown voltage between the gate and emitter. In addition, R1 should be at the value required for turning ON the thyristor 24.

Figure 6:
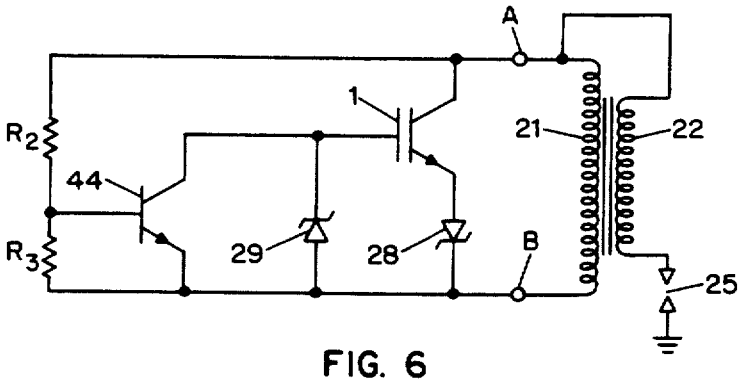
FIG. 6 is a circuit diagram of the ignition system utilizing a further embodiment of the present invention.

FIG. 6 illustrates an ignition system utilizing another embodiment of the present invention, whereby operation similar to that of the circuit depicted in FIG. 1 is achieved with a simpler arrangement. In this embodiment, a transistor 44 is used in place of the thyristor 24 for turning OFF the IGBT 1. In addition, the resistor R1 and diode 30 are not used since the transistor 44 does not require the holding current for maintaining the conductive condition as does the thyristor 24. Moreover, it is possible to apply a charging current to the gate G of IGBT 1 from the base of the transistor 44 through the collector, even if diode 29 is not provided. However, when the value of resistor R3 is large, it is better to use diode 29 to decrease the charging time. If a transistor is used in place of the thyristor 24 in the prior art circuit of FIG. 2, the transistor turns OFF with the divided voltage of resistors R2 and R3 when that voltage drops a certain amount, and the Darlington transistor 23 may undesirably turn ON through the resistor R1. However, in the circuit of FIG. 6, when charges accumulated at the gate of IGBT 1 are discharged when the transistor 44 turns ON, this problem does not occur because IGBT 1 does not turn ON even when the transistor 44 turns OFF. In addition, the charges accumulated at the gate of IGBT 1 are capable of holding the charges sufficient for turning ON the IGBT 1 during a single turn of the flywheel magnet, and injection of charges to the gate from terminal A of the ignition coil 2 is no longer necessary. However, if IGBT 1 becomes non-conductive due to leakage of charges accumulated during a single turn, it is necessary to add resistor R1 and diode 30, as shown in FIG. 1. Accordingly, in this case, it is preferred to use the thyristor 24 as shown in FIG. 1 in place of the transistor 44.

Explained above is an example using an IGBT, additionally, similar circuit operations are possible when using other types of insulated gate semiconductor devices, such as a MOSFET. If the voltage generated at the ignition coil 2 is low, the MOSFET is superior. However, if the voltage generated at the ignition coil 2 is very high and a backwards dielectric strength of several hundred volts is required, the IGBT is superior due its lower power consumption. Since the cut-off speed of the IGBT or MOSFET is several times faster than the Darlington transistor 23 of FIG. 2, the voltage generated can be increased while the number of turns of the ignition coil 2 can be decreased, for the same conductive current.

Moreover, the IGBT or MOSFET, when used under a coil load or alternate voltage, can be driven with a low voltage bias by utilizing the backward voltage. Therefore, these devices can be used effectively in various aspects in accordance with the present invention. In addition, it will be apparent to those skilled in the art that the present invention can be applied to any type of N channel and P channel elements.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A method for biasing an insulated gate semiconductor device, of the type having gate and first main electrodes at one surface of a semiconductor substrate, a second main electrode at a second substrate surface, and a gate to second main electrode capacitance which is a multiple of the gate to first main electrode capacitance under low voltage conditions, comprising the steps of:

(a) accumulating a charge between said gate and second main electrodes in response to a first voltage coupled across said main electrodes in a non-conductive polarity;

(b) preventing leakage of said charge as it accumulates by providing electrical isolation for charges of the resulting polarity; and (c) causing the accumulated charge to discharge between said gate and first main electrodes in response to a second voltage applied across said main electrodes in the opposite polarity to said first voltage, thereby temporarily biasing said gate electrode to a potential adequate to cause the semiconductor device to enter a conductive state;

whereby a bias of increased voltage results from the difference in inter-electrode capacitances and is effective to drive the semiconductor device.

2. The method of claim 1, further comprising the step of causing said semiconductor device to rapidly change from a conductive to a non-conductive state.

3. The method of claim 2, further comprising the step of causing a termination of current flow resulting from said change of the semiconductor device from a conductive to a non-conductive state, thereby generating an increased voltage in a primary winding of a coil connected thereto.

4. The method of claim 3, further comprising the step of coupling the resulting energy generated in the secondary winding of said coil to an ignition plug connected thereto.

5. A method for providing electrical energy to an ignition plug of an internal combustion engine, utilizing an insulated gate semiconductor device of the type having gate and first main electrodes at the surface of a semiconductor substrate, a second main electrode at a second substrate surface, and a gate, to second main electrode capacitance which is a multiple of the gate to first main electrode capacitance under low voltage conditions, comprising the steps of:

(a) rotating a flywheel magnet through the field of an ignition coil alternately to generate voltages of a first and reverse polarity in the primary winding of said coil;

(b) accumulating a charge between said gate and second main electrodes in response to a first voltage coupled across said main electrodes in a non-conductive polarity;

(c) preventing leakage of said charge as it accumulates by providing electrical isolation for charges of the resulting polarity;

(d) causing the accumulated charge to discharge charge between said gate and first main electrodes in response to the reverse voltage applied across said main electrodes, thereby temporarily biasing said gate electrode to a potential adequate to cause the semiconductor device to enter a conductive state;

(e) causing said semiconductor device to rapidly change from a conductive to a non-conductive state, thereby generating an increased voltage in the primary winding of said ignition coil; and (f) coupling resulting energy generated in the secondary winding of said coil to the ignition plug of the engine.

6. An ignition circuit for an internal combustion engine, comprising:

(a) inductive means for alternately coupling voltages of a first and a reverse polarity across first and second circuit points;

(b) an insulated gate semiconductor device having first and second main electrodes respect coupled to said first and second points, and having a gate electrode;

(c) first means, coupling said gate electrode to said first point, for coupling voltages of said polarity to said gate electrode and for preventing of charge from said gate electrode;

(d) second means, coupled between said first main electrode and said first circuit point and responsive to reverse polarity voltages, for permitting discharge of said gate electrode via said second main electrode, thereby rendering said semiconductor device conductive; and (e) third means, coupled between said gate electrode and said second circuit point and responsive to said reverse polarity voltages, for causing said semiconductor device to become non-conductive;

whereby, said semiconductor device having been rendered conductive by said discharge of the gate electrode, causes generation of ignition firing voltages in said inductive means upon being rendered non-conductive.

7. An ignition circuit as in claim 6, in which said semiconductor device is an insulated gate bipolar transistor.

8. An ignition circuit as in claim 6, in which said first and second means comprises diodes.

9. An ignition circuit as in claim 6, 7 or 8, in which said third means comprises a transistor having a resistive voltage divider coupling its control electrode between said first and second circuit points.

10. An ignition circuit as in claim 6, 7 or 8, in which said third means comprises a thyristor having a resistive voltage divider coupling its control electrode between said first and second circuit points.

11. An ignition circuit for an internal combustion engine, comprising:

(a) an ignition coil having a primary winding coupled across first and second circuit points and a secondary winding for supplying energy to an ignition plug;

(b) an insulated gate semiconductor device having a first main electrode, a second main electrode coupled to said second point, and a gate electrode;

(c) a first diode coupled between said gate electrode and said first point;

(d) a second diode coupled between said first main electrode and said first point;

(e) a semiconductor device having main electrodes coupled to said gate electrode and said first point, and having a control electrode; and (f) a voltage divider coupling said control electrode to said first and second points.

12. An ignition circuit as in claim 11, additionally comprising a third diode coupled between said gate electrode and said second point.

13. An ignition circuit as in claim 11 or 12, in which said insulated gate semiconductor device is an insulated gate bipolar transistor.

14. An ignition circuit as in claim 11 or 12, in which said insulated gate semiconductor device is an insulated gate bipolar transistor, and said first and second diodes are zener diodes.

15. An ignition circuit as in claim 11, in which said semiconductor device is a transistor and said voltage divider comprises two resistive elements in series coupled between said first and second circuit points, with the midpoint coupled to said control electrode.

16. An ignition circuit as in claim 12, in which said semiconductor device is a thyristor and said voltage divider comprises two resistive elements in series coupled between said first and second points, with the midpoint coupled to said control electrode.

* * * * *

UNITED STATES PATENT AND TRADEMARK OFFICE

CERTIFICATE OF CORRECTION

PATENT NO. : 4,993,396

DATED : February 19, 1991

INVENTOR(S) : Shunji Miura

It is certified that error appears in the above-identified patent and that said Letters Patent is hereby corrected as shown below:

Column 8, line 4, "the surface" should read --one surface--;

Column 8, line 6, "gate, to" should read --gate to--;

Column 8, line 42, "respect" should read --respectively--; and

Column 8, line 47, "preventing" should read --preventing leakage--.

Signed and Sealed this

First Day of December, 1992

*Attest:*

DOUGLAS B. COMER

*Attesting Officer*

*Acting Commissioner of Patents and Trademarks*